US005149261A

United States Patent [19]

Suwa et al.

[11] Patent Number: 5,149,261

[45] Date of Patent: Sep. 22, 1992

[54] OXYGEN HEATER AND OXYGEN LANCE USING OXYGEN HEATER

[75] Inventors: Toshio Suwa, Kawasaki; Nobuaki Kobayashi; Takashi Hirano, both of Tokyo, all of Japan

[73] Assignee: Nippon Sanso Kabushiki Kaisha, Tokyo, Japan

[21] Appl. No.: 445,194

[22] Filed: Dec. 4, 1989

Related U.S. Application Data

[63] Continuation-in-part of Ser. No. 86,734, Jul. 9, 1987, Pat. No. 4,928,605.

[30] Foreign Application Priority Data

Nov. 15, 1985 [JP] Japan ..... 60-256351
Nov. 15, 1985 [JP] Japan ..... 60-256352
Nov. 15, 1985 [JP] Japan ..... 60-256353

[51] Int. Cl.[5] ..... F23D 1/00; F23C 1/10

[52] U.S. Cl. ..... 431/207; 431/11; 431/160; 431/350; 431/353

[58] Field of Search ..... 431/11, 160, 207, 158, 431/187, 210, 215, 115, 232, 235, 236, 239, 242, 353, 8, 10, 159, 350, 351, 349; 60/736

[56] References Cited

U.S. PATENT DOCUMENTS 878,461 2/1908 Harris ..... 431/10
1,163,650 12/1915 Fogler ..... 431/160 X
2,219,917 10/1940 Crosiar ..... 431/236 X
2,901,032 8/1959 Brola ..... 431/264
3,030,793 4/1962 Johnson ..... 431/9
3,182,711 5/1965 Robb ..... 431/353
3,661,561 5/1972 Frey, Jr. et al. ..... 75/68 A X
3,733,169 5/1973 Lefebvre ..... 431/353 X
3,890,088 6/1975 Ferri ..... 60/736 X
3,986,817 10/1976 Lambiris ..... 431/264
4,928,605 5/1990 Suwa et al. ..... 431/11 X

FOREIGN PATENT DOCUMENTS 59-501278 7/1984 Japan .

*Primary Examiner*—Carl D. Price
*Attorney, Agent, or Firm*—Kane, Dalsimer, Sullivan, Kurucz, Levy, Eisele and Richard

[57] ABSTRACT

There is disclosed an oxygen heater, which uses a portion of supplied oxygen as auxiliary combustion oxygen, a hot oxygen lance and a pulverized solid fuel burner, both having oxygen heaters. The oxygen heater has a combustion chamber for burning fuel with a portion of the supplied oxygen. An oxygen-jetting opening is disposed around the combustion chamber. The oxygen jetted out of the opening forms a gas curtain between an internal wall of a mixing chamber and a flame produced in the combustion chamber, and is heated by the flame. Both the oxygen lance and the burner includes the above-mentioned oxygen heater.

19 Claims, 7 Drawing Sheets

OXYGEN HEATER AND OXYGEN LANCE USING OXYGEN HEATER

This is a continuation-in-part of copending Ser. No. 07/086,734 filed on Jul. 9, 1987 now U.S. Pat. No. 4,928,605, issued May 29, 1990.

BACKGROUND OF THE INVENTION

This invention relates to an oxygen heater for producing hot oxygen which is required in the refining of ferrous and nonferrous metals, such as the direct reducing smelting of aluminum.

This invention also relates to a lance for supplying hot oxygen to a zone for the refining of ferrous and nonferrous metals such as, in particular, the reduction zone of a direct reducing furnace.

This invention further relates to a pulverized solid fuel burner used in an electric furnace for melting steel scrap, aluminum, copper and the like.

Recently, there have been developed, methods of refining aluminum in a blast furnace. In the conventional methods, such as disclosed in U.S. Pat. No. 3,661,561, oxygen preheated to approximately 1,000° C. is blown into a blast furnace through a plurality of tuyeres of the furnace. In these processes, in order for the refining of aluminum in the blast furnace to be successful, it has been important subject how efficiently the preheated oxygen was generated and supplied to the furnace. One of the prior heater devices used in an experiment produced the hot oxygen by effecting the heat exchange between oxygen of room temperature and a fluid generated by another heat source. However, in the experiment using this particular heater device, the amount of the produced hot oxygen was several tens of thousand $Nm^3/h$. Consequently, it is not economical to apply the above-mentioned way of preheating oxygen to the preheating process when there is no utilizable heat source and when a specific heat source must be newly prepared.

Also, the use of hot oxygen in the refining process of steel or zinc, has been suggested. It is desired in this case to provide a device that can produce and supply a great amount of hot oxygen safely and efficiently.

In the refining of iron or aluminum, air or oxygen-enriched air is supplied to a furnace through the tuyere or the lance of the furnace after it is heated up to a high temperature. An example of the heater which is applicable to this refining is shown in International Patent Application No. PCT/US83/949 which corresponds to International Japanese Domestic Publication of Translated PCT Application No. 59-501278, or to U.S. Ser. Nos. 391,602 (Jun. 6, 1982) and 493,247 (May 10, 1983). This heater, i.e., a burner which also serves as a lance is used for heating metal products in a fusion furnace. Oxygen is discharged in a jet from the nozzle of the burner and fuel is supplied from the conduit concentrically surrounding the nozzle. The supplied fuel is then jetted into the discharged oxygen and is burned with the oxygen, which produces hot oxygen including combustion gas. Depending on the purpose, the oxygen content of the combustion gas is controlled and the heater is used either as a burner or as a lance for hot oxygen-containing combustion gas.

However, there arises a problem of the temperature of the peripheral portion of the burner rising severely since the construction of the burner is such that fuel supplied from the nozzle-surrounding conduit is jetted into and mixed with the oxygen flow and is burned within the burner so that the hot combustion gas including oxygen is produced.

These days, there are used, burners which utilize pulverized coal as their main fuel for the purpose of melting steel scrap, aluminum, copper and the like. These burners must produce flames having stable temperatures of not less than approximately 2,000° C. so that the burners have the required melting capacity. However, the combustion rate of pulverized coal is extremely slow in comparison with that of a liquid fuel such as fuel oil or a gaseous fuel such as $CH_4$, $C_3H_8$ and the like. Also, the flame temperature of pulverized coal is lower than that of the liquid or gaseous fuel. It is not easy to produce a stable flame by the monofuel combustion of pulverized coal. The flame due to the monofuel combustion is unstable and sometimes extinguished when the temperature of the atmosphere in the vicinity of the burner in a furnace is low, causing its radiant heat to be reduced. For these reasons, there have been used, burners which utilize a gaseous or liquid fuel such as LPG, natural gas, fuel oil and the like. The pulverized coal has been used as the fuel of combination burners which also use a liquid or gaseous fuel along with the pulverized coal. However, the combination burners are not economical enough since the mixture ratio of liquid or gaseous fuel must be increased, that is, the consumption of the pulverized coal must be decreased in order for the combination burners to produce flames of high temperature.

FIG. 1 shows an instance of the conventional combination burner which uses pulverized coal mixed with a liquid fuel. This burner has six cylinders coaxially disposed to each other, wherein the innermost cylinder is a conduit 231 for supplying liquid fuel, the cylinder surrounding the conduit 231 is a conduit 232 for supplying auxiliary combustion gas for assisting the combustion of the liquid fuel, the cylinder surrounding the conduit 232 is a conduit 233 for supplying pulverized coal, the cylinder surrounding the conduit 233 is a conduit 234 for supplying auxiliary combustion gas for assisting the combustion of the pulverized coal, and the last cylinder surrounding the conduit 234 is a jacket 235 for circulating cooling water. The liquid fuel-supplying conduit 231 is provided at its front end with a nozzle 236 for discharging the liquid fuel supplied through the conduit 231 in a jet. Also, the auxiliary combustion gas-supplying conduit 232 is provided at its front end with a ring 237 which forms the nozzle for discharging the auxiliary combustion gas in a jet. The auxiliary combustion gas is jetted from the annular opening 238 defined by both the outer periphery of the nozzle 236 and the ring 237, and is mixed with the liquid fuel to produce a primary flame. Reference numeral 239 denotes a cylinder which defines a main combustion chamber 240 in cooperation with the liquid fuel nozzle 236, the front end of the auxiliary combustion gas-supplying conduit 232 and the front end of the pulverized coal-supplying conduit 233. The rear end of the main combustion chamber 240 is in fluid communication with an outlet 241 of the pulverized coal-supplying conduit 233. Around the outlet 241, an outlet 242 for jetting a portion of auxiliary combustion gas is open and is in communication with the rear end of the main combustion chamber 240. The pulverized coal discharged from the outlet 241 is mixed with the auxiliary combustion gas discharged from the outlet 242 and is burned by the assistance of the primary flame by the liquid fuel, producing a secondary flame. In front of the combustion chamber 240, a sub-combustion chamber 243 is defined by the inner face of the auxiliary combustion gas-supplying conduit 234 and the front face of main combustion chamber 240. The remainder of the auxiliary combustion gas is jetted into the sub-combustion chamber 243 through the space between the cylinder 239 and the conduit 234, and surrounds the primary and secondary flames to achieve a perfect combustion. In short, in the conventional burners, the flame produced by the liquid fuel and the flame produced by the pulverized coal are combined and form a unitary flame.

As has been described, although it has been planned and tested the blowing of hot oxygen into smelting furnaces upon refining ferrous and nonferrous metals, there has been no oxygen heater, so far, which can efficiently heat an extremely large quantity of oxygen without severely lowering the purity of the oxygen and which is concerned about the safety and durability of itself during the heating process.

Also, the conventional burner uses an unnecessarily large amount of fuel since the hot combustion gas in the vicinity of the burner is cooled by the cooling water circulating in the jacket of the burner, increasing the heat loss. As a result, there arises a problem of the oxygen content of the combustion gas being decreased. That is, the decrease of the oxygen content is not desirable upon the refining of ferrous and nonferrous metals such as, in particular, the fused reduction of aluminum.

Furthermore, there has existed no monofuel combustion burner, for use in a furnace such as an electric furnace for steel scrap, fusion furnace for aluminum and a reverberatory furnace for copper, which is capable of producing a stable flame of high temperature and has a excellent fusing ability even if it is used at regions in the furnaces where the temperature of the atmosphere in the vicinity of burner is relatively low.

SUMMARY OF THE INVENTION

The present invention is proposed regarding the above-mentioned situation. An object of the present invention is to provide an oxygen heater which is capable of heating a large quantity of oxygen efficiently without severely lowering the purity of oxygen.

Another object of the present invention is to provide an oxygen heater and an apparatus such as an oxygen lance having an oxygen heater, which is concerned about the safety and durability of itself during the heating process, and which is, in particular, concerned about the durability of an internal wall of a mixing chamber in which combustion gas is mixed with oxygen.

A further object of the present invention is to provide an oxygen lance having an oxygen heater which has a compact construction and reduces the heat loss such as, in particular, the heat loss in the combustion gas-producing region, thereby producing hot gas having a high oxygen content.

A further object of the present invention is to provide a pulverized solid fuel burner in which the pulverized solid fuel is used as the main fuel and gaseous or liquid fuel is used merely for preheating auxiliary combustion gas.

With these objects in view, one aspect of the present invention is directed to an oxygen heater including an internal wall defining a mixing chamber, oxygen supply means, a combustion chamber, fuel supply means, and an oxygen-jetting opening formed in the wall defining the combustion chamber. In the combustion chamber, fuel is mixed with and burned with oxygen. The opening is disposed around the combustion chamber so that the oxygen jetted out of the opening forms a gas curtain between the internal wall of the mixing chamber and a flame produced in the combustion chamber. In this oxygen heater, a portion of the supplied oxygen is used as an auxiliary combustion gas, whereby the remainder of the supplied oxygen is heated up.

The oxygen heater may include control means for controlling the flow rate of oxygen supplied to the combustion chamber within the range of 1 to 5 times more than an oxygen flow rate which is theoretically adequate to completely burn the fuel supplied to the combustion chamber. In this case, fuel supplied to the combustion chamber is mixed with an adequate or excess amount of oxygen and burned with such an amount of oxygen.

The oxygen-jetting opening may comprise a plurality of nozzles or one or more slits. The opening may be arranged so that the oxygen jetted out of the opening forms a multilayer of gas curtains. Also, in this case, the opening may be arranged so that the flow rate or flow velocity of an inner gas curtain is larger than that of an outer gas curtain.

In case that the internal wall is made of a metal, the internal wall may be provided at its outer face with a heat-insulating layer and/or a cooling jacket.

The aforementioned fuel may be gaseous or liquid fuel. The fuel-jetting opening must be the proper one needed for the type of fuel used for the heater.

The oxygen used for the heater is usual industrial oxygen having a purity of 99.8%. Naturally, oxygen produced by a PSA, having a purity of 90%, is also applicable to the heater.

The operation of the oxygen heater will now be described.

The fuel supply means supplies fuel to the combustion chamber at a predetermined flow rate, while at the same time, some of the oxygen supplied by the oxygen supply means is introduced into the combustion chamber. If the heater employs the control means, the control means controls and adjust the flow rate of oxygen introduced into the combustion chamber to a value of 1 to 5 times (preferably 1 to 3 times) more than the oxygen flow rate which is theoretically adequate to completely burn the fuel supplied to the combustion chamber at the predetermined flow rate. Then, the mixture of the fuel and the oxygen is burned, whereby a stable flame of a relatively short and sharp shape is blown out of the opening of the combustion chamber. Most of the remainder of the oxygen, which is to be heated up, is jetted out of the nozzles or slits for forming the oxygen curtain surrounding the produced flame. The oxygen curtain prevents the internal wall both from being local overheated and from unnecessarily releasing heat, thereby protecting both the internal wall made of metal and the internal wall made of refractory material.

Also, the curtain oxygen cools not only a chamber-forming member which defines the oxygen-jetting opening but also the combustion chamber. The curtain oxygen is mixed in front of the combustion chamber with the combustion gas that is produced in the combustion chamber to be oxygen-containing hot gas, and the hot gas is supplied to the place where it is demanded. The maximum temperature of the hot gas at the outlet of the heater is equal to the temperature of a perfect mixture of the combustion gas and oxygen having room temperature. When the temperature of the hot gas at the outlet is approximately 700° to 1,000° C., there is no need for the cooling jacket surrounding the internal metal wall since the oxygen curtain protect this internal metal wall. When the temperature of the hot gas increases to 1,200° C. and over, cooling means such as a cooling jacket for cooling the metal internal wall must be provided.

The preferable cooling means are, to arrange a multilayer of oxygen curtains. This results in a stable streamline flow of curtain oxygen protecting the internal wall more effectively. In this case, by making the flow rate or flow velocity of an inner curtain oxygen higher than that of the outer curtain oxygen, the outer oxygen curtain adjoined to the internal wall is retained more successfully and protects the the internal wall completely. In order to make the flow rate of the inner curtain oxygen higher than that of the outer curtain oxygen, outer curtain nozzles for forming the outer oxygen curtain may be designed such that the inner diameter of each outer curtain nozzle is considerably smaller than that of each of inner curtain nozzles for forming the inner oxygen curtain. While, in order to make the flow velocity of the inner curtain oxygen higher than that of the outer curtain oxygen, outer curtain nozzles for forming the outer oxygen curtain may be designed such that the inner diameter of each outer curtain nozzle rapidly increases as the nozzle extends forward along the direction of oxygen flow.

Although the oxygen heater according to the present invention is proposed as a heater for supplying a great amount of hot oxygen for smelting, its use is also naturally applicable to other objects which require hot oxygen.

According to the oxygen heater of the present invention, a great amount of hot oxygen for refining can be produced efficiently by using little fuel for heat source. Also, the heater of the present invention prevents the internal wall from being local overheated, thereby enhancing the safety and durability of the heater itself both when the internal wall is made of metal and when the internal wall is made of refractory. Furthermore, this total apparatus is capable of being compact.

Since, in this heater, heat loss from the internal wall to outside the heater is minimized, the amount of the fuel used for heating oxygen is reduced, whereby there is produced, hot gas having a high oxygen content even though this hot gas has a relatively high temperature.

Another aspect of the present invention is directed to a hot oxygen lance including an outer cylinder, an oxygen supply means, and an oxygen heater. The oxygen heater includes a combustion chamber, fuel supply means, and oxygen nozzles. In the combustion chamber, fuel is mixed with and burned with oxygen. The oxygen nozzles direct the oxygen passing therethrough to form an oxygen curtain surrounding the combustion chamber. The hot oxygen lance may includes control means for controlling the flow rate of oxygen supplied to the combustion chamber within the range of 1 to 5 times more than an oxygen flow rate which is adequate to completely burn the fuel supplied to the combustion chamber. A heat-insulating layer and/or a cooling jacket may be disposed around a part of, or the entire, outer cylinder. Also, the lance may have a center pipe around which a plurality of the combustion chambers, in which the fuel is mixed and burned with oxygen, are provided. The oxygen nozzles may be arranged so that a multilayer of oxygen curtains coaxial to one another are formed. In this case, it is preferred to arrange the oxygen nozzles so that the flow rate or flow velocity of an outer oxygen curtain is higher than that of an inner oxygen curtain.

It is also preferred that the fuel used for the lance is gaseous or liquid fuel.

Furthermore, the outer cylinder may have a branch cylinder in which the oxygen heater is disposed. The oxygen nozzle for forming the oxygen curtain may be a plurality of small holes or a slit.

The operation of this oxygen lance is as follows: The fuel supply means supplies fuel to the combustion chamber at a predetermined flow rate, while at the same time, some of the oxygen supplied by the oxygen supply means is introduced into the combustion chamber. If the oxygen lance employs the control means, the control means controls and adjusts the flow rate of oxygen introduced into the combustion chamber to a value of 1 to 5 times more than the oxygen flow rate which is theoretically adequate to completely burn the fuel supplied to the combustion chamber at the predetermined flow rate. The fuel is, then, burned with the oxygen and produces a stable flame of a relatively short and sharp shape, which blows out from the front opening of the combustion chamber. The remainder of the oxygen, that is, most of the supplied oxygen that is to be heated up is blown out of the small holes or the slit along the inner surface of the outer cylinder, resulting in the formation of the oxygen curtain. The oxygen curtain prevents the outer cylinder from local overheating and reduces the heat radiation from the outer cylinder. In other words, by making oxygen of room temperature flow between the flame and the outer cylinder, the outer cylinder is protected from the heat and the heat loss from the outer cylinder is reduced and fuel consumption is lowered. Therefore, oxygen-containing gas having a high oxygen content and a high temperature is produced. This oxygen curtain also cools the oxygen heater (that is, a burner nozzle) which constitutes the combustion chamber. Furthermore, the oxygen lance may be provided at its center position with a center pipe either for supplying pulverized material or for observing the inside of a furnace. A plurality of the combustion chambers may be disposed circumferentially around the center pipe. In this case, the oxygen curtain should be formed so as to enclose each of the combustion chambers, whereby both the center pipe and the outer cylinder are prevented from being overheated and the heat radiation from both the center pipe and the outer cylinder is reduced. Consequently, the fuel consumption of the lance is lowered and the oxygen-containing gas having a high temperature and a high oxygen content is produced.

The combustion gas produced in the combustion chamber is mixed with the curtain oxygen in front of the combustion chamber and is jetted out of the front opening of the outer cylinder. Thus, the maximum temperature of the mixed hot gas in contact with the outer cylinder is equal to the temperature of complete mixture of the combustion gas and oxygen at room temperature. When the temperature of the hot gas jetted out of the front opening of the lance is approximately 700° to 1,000° C., the cooling jacket as means for protecting the outer cylinder is not necessary since the oxygen curtain is capable of cooling the outer cylinder efficiently. However, when the temperature of the produced hot gas exceeds 1,200° C., the cooling jacket and the like is necessary for protecting the metal outer cylinder.

It is preferred to arrange the oxygen curtains in multilayer in order to make the streamline flow of the oxygen stable, causing the outer cylinder to be protected effectively. By increasing the flow rate or flow velocity of an inner curtain oxygen higher than that of an outer curtain oxygen, the outer oxygen curtain is retained stably, whereby the outer cylinder is both protected from heat and prevented from releasing heat almost perfectly. In the same and almost perfect manner, the center pipe is both protected from heat and prevented from releasing heat in case of the lance having the center pipe.

In the hot oxygen lance of the present invention, gaseous or liquid fuel and auxiliary combustion oxygen are introduced into the combustion chamber and are burned to produce a flame. The combustion gas due to the flame and oxygen is mixed so that oxygen-containing hot gas is produced. Since the lance has an oxygen heater in which is included an oxygen nozzle for forming oxygen curtain which encloses the combustion chamber, it is possible to protect the outer cylinder and to reduce the heat loss from the outer cylinder to a minimal level.

In case that the lance is provided at its center position either with a pulverized material-supplying conduit or with a conduit for observation, a plurality of the combustion chambers are circumferentially disposed around the center pipe so that there are produced oxygen curtains enclosing the combustion chambers, whereby both the outer cylinder and the center pipe are protected and the heat loss is decreased to a minimal level. Consequently, with a small amount of fuel capable of raising the temperature of oxygen, hot combustion gas having a high oxygen content can be produced. Also, when the temperature of the hot gas blown out of the jetting opening of the lance is approximately 700° to 1,000° C., means for cooling the outer cylinder, such as the cooling jacket can be omitted Still another aspect of the present invention is directed to a pulverized solid fuel burner having a burner body and an auxiliary combustion gas heater. The auxiliary combustion gas heater produces hot auxiliary combustion gas by mixing and burning gaseous or liquid fuel with a portion of the supplied auxiliary combustion gas and, by mixing the combustion gas which results from the combustion of the fuel with the rest of the auxiliary combustion gas which is to be used for burning pulverized solid fuel. The pulverized solid fuel may be preheated due to the heat transfer from the hot auxiliary combustion gas, and then, may be mixed and burned with the hot auxiliary combustion gas. Furthermore, the burner may have a main combustion chamber in which the pulverized solid fuel is both mixed and burned with the hot auxiliary combustion gas. The auxiliary combustion gas may comprise oxygen, oxygen-enriched air or air. Also, heat-insulating layers may be disposed on that portion of the burner body where the auxiliary combustion gas heater is attached and on that portion of the burner body which the hot auxiliary combustion gas is brought into contact with. The cooling jacket through which cooling water circulates may be circumferentially provided on the outer surface of the burner body.

The operation of the burner according to the present invention is described as follows: In the auxiliary combustion gas heater, gaseous fuel such as propane and methane, or liquid fuel such as kerosine and heavy oil is burned with auxiliary combustion gas, whereby the hot combustion gas is produced. This hot combustion gas is mixed with auxiliary combustion gas, producing hot auxiliary combustion gas. This hot auxiliary combustion gas is both mixed and burned with pulverized solid fuel such as pulverized coal as the main fuel within the main combustion chamber defined at the front end portion of the burner, producing a stable flame having a temperature of about 2,000° to 2,400° C. It is possible to preheat the pulverized solid fuel to make the flame even more stable if the main combustion chamber is spaced from the auxiliary combustion heater at an adequate distance.

As has been described, the burner according to the present invention has an auxiliary combustion gas heater, and uses pulverized coal as its main fuel. The effects of the invention are that a stable flame due to combustion of pulverized solid fuel, the flame having a temperature of 2,000° to 2,400° C., can be produced, and that energy cost is reduced and the size miniaturized, in contrast to combustion burners using gaseous or liquid fuel mixed with pulverized solid fuel.

BRIEF DESCRIPTION OF THE DRAWINGS

In the drawings:

FIG. 2(*b*) illustrates a block diagram showing the method of connecting the oxygen heater with the oxygen supply means in the above example of the first embodiment.

FIG. 2(*c*) illustrates a cross section of an example device of the first embodiment of the present invention.

FIG. 2(*d*) illustrates a cross section of an example device of the first embodiment of the present invention.

DETAILED DESCRIPTION OF THE PREFERRED EMBODIMENTS

Embodiment 1

Figure 1:
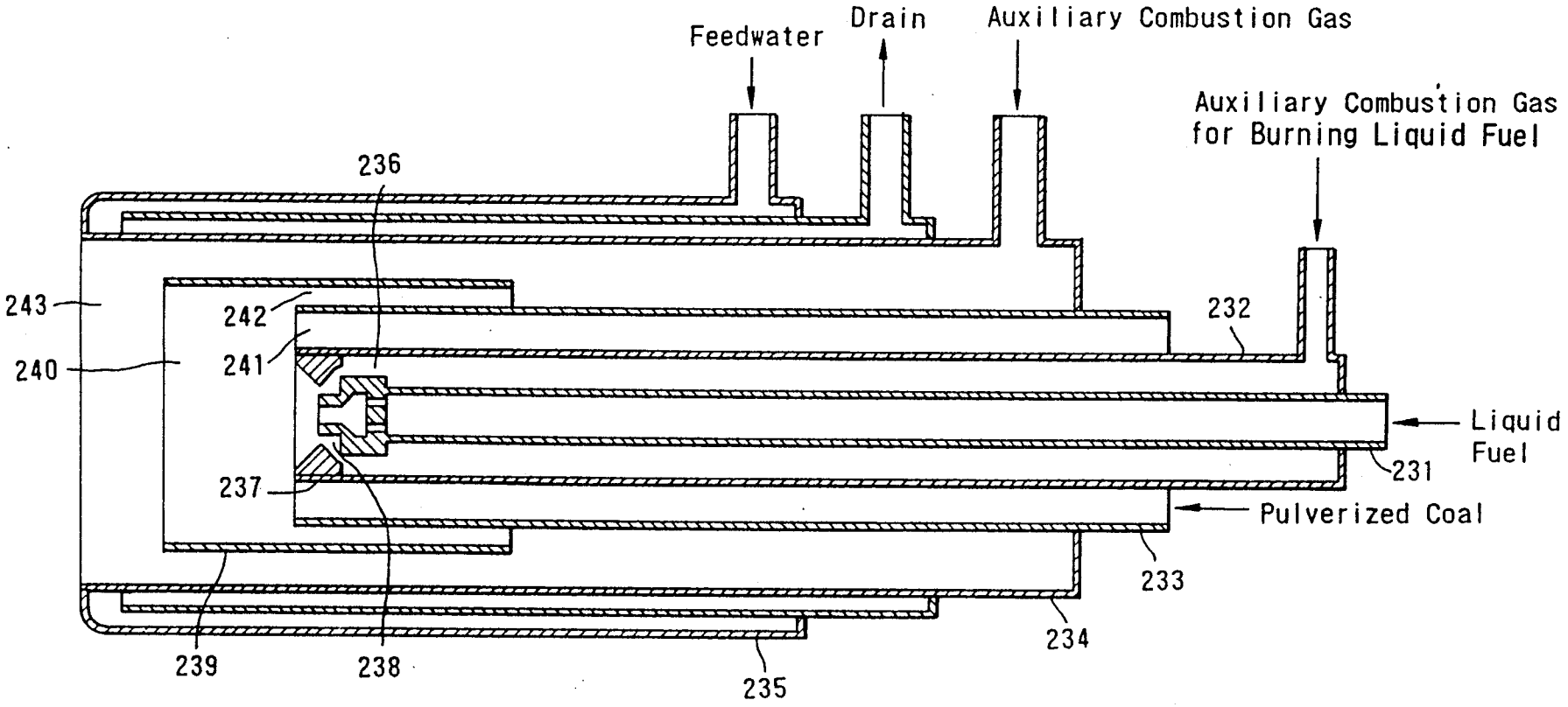
FIG. 1 (PRIOR ART)
FIG. 1 is an axial-sectional view of a conventional combination burner which uses pulverized coal mixed with liquid fuel.
Figure 2:
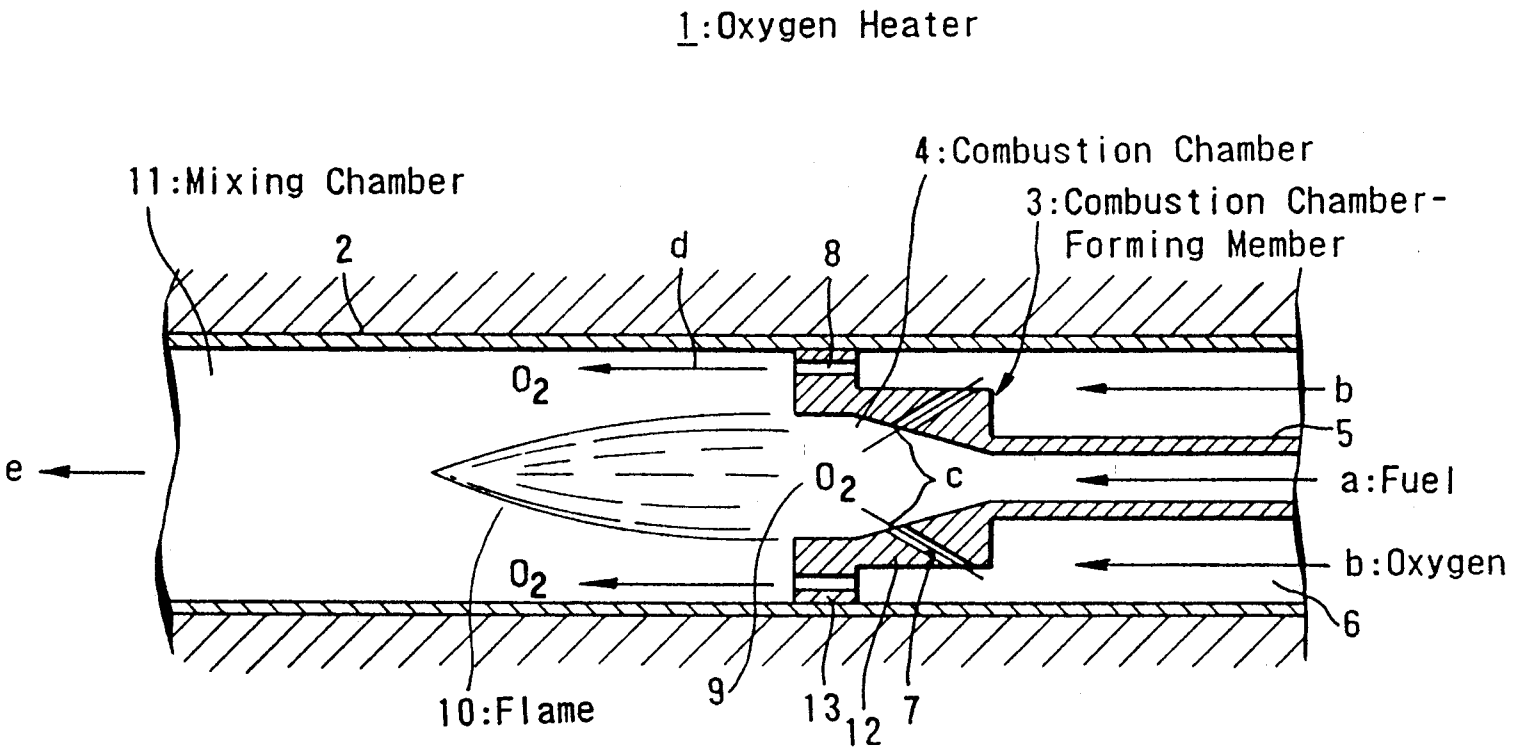
FIG. 2(*a*) is an axial-sectional view of an oxygen heater according to embodiment 1 of the present invention.

FIG. 2 shows an oxygen heater according to the first aspect of the present invention. In FIG. 2, reference numeral 1 designates the oxygen heater, and reference numeral 2 denotes a cylindrical internal wall which forms a mixing chamber 11 of the oxygen heater 1. This internal wall 2 is made of such material as fireproofing material or metal. Reference numeral 3 designates a combustion chamber-defining member disposed inside the internal wall 2. This chamber-defining member 3 has a substantially hollow cylindrical body 12 and a flange portion 13 unitarily formed around the front end portion of the body 12. The flange portion 13 fits fixedly in the internal wall 2, and thereby places the body 12 coaxially with the internal wall 2. A combustion chamber 4 is defined by the inner surface of the body 12. The inner surface of the body 12 is tapered from its intermediate portion to the rearward end so that the inner diameter of the body 12 is gradually reduced as the body extends rearward. In other words, the combustion chamber 4 includes a front section of a cylindrical configuration and a rear section of a truncated conical configuration, the front section opening to the front end of the body 12, the rear section opening to the rear end of the body 12. A fuel-supplying conduit 5 is disposed in the internal wall 2. The front end of the conduit 5 is connected to the rear end of the body 12 and is open to the combustion chamber 4. This conduit 5 passes out of the internal wall 2, and the rear end of the conduit 5 leads to a fuel supply source 122 (see FIG. 2(*b*)) outside the internal wall. An oxygen-supplying passage 6 is defined between the internal wall 2 and the outer surface of the conduit 5. More specifically, the passage 6 of a substantially cylindrical configuration surrounds the conduit 5 and extends along the conduit 5 to the rear end face of the flange portion 13. This passage 6 leads to an oxygen supply source 120 (see FIG. 2(*b*)) outside the internal wall 2. It is further permissible to connect the oxygen heater 1 to fuel supply source 122 by means of a conduit 5, and the oxygen heater 1 and the oxygen supply source 120 with an oxygen-supplying passage 6, to which passage may be attached a control valve 121. A plurality of nozzle holes 7 for jetting auxiliary combustion oxygen are formed through the body 12 so that the passage 6 comes into fluid communication with the combustion chamber 4 through the nozzle holes 7. These nozzle holes 7 are arranged circumferentially in the body 12 at angular intervals about the axis of the internal wall 2. Each nozzle hole 7 extends along a line inclined to a plane perpendicular to the axis of the internal wall 2 so that oxygen to be discharged from the nozzle holes 7 and to be jetted into the combustion chamber 4 is directed toward the vicinity of the intersection of the axis of the internal wall 2 and a plane in which the front opening 9 of the combustion chamber 4 is laid. Furthermore, a plurality of outlet holes 8 for forming curtain oxygen are formed through the axial length of the flange portion 13 so that the passage 6 becomes in fluid communication with the mixing chamber 11. These outlet holes 8 are also circumferentially arranged in the flange portion 13 at angular intervals about the axis of the internal wall 2. Oxygen introduced into the outlet holes 8 and jetted into the mixing chamber 11 is to be mixed with combustion gas which is to be produced as a result of combustion in the combustion chamber 4. The respective cross-sectional areas of each nozzle hole 7 and each outlet hole 8, and the angles of inclination of each nozzle hole 7 are selected in order to properly control the respective oxygen flow rates in each nozzle hole 7 and each outlet hole 8 (see FIG. 2(*c*)). Further, as shown in FIG. 2(*d*), it is permissible to shape the oxygen nozzles or outlet holes 8' in a slit form. For example, the sum of the cross-sectional areas of the outlet holes 8 is greater than the sum of the cross-sectional areas of the nozzle holes 7 so that the flow rate of oxygen introduced into the mixing chamber 4 through the outlet holes 8 is approximately 4 to 17 times more than the flow rate of oxygen introduced into the combustion chamber 4. Reference numeral 9 designates the front opening of the combustion chamber 4, and reference numeral 10 designates a flame.

Also, in FIG. 2, reference letter a designates a flow of fuel, b designates a flow of oxygen, c denotes a flow of auxiliary combustion oxygen, d denotes a flow of curtain oxygen, and e denotes a flow of hot oxygen-containing combustion gas.

In addition to the structure shown in FIG. 2(*a*) and FIG. 2(*b*), a flow rate control means such as a control valve is provided on a conduit which communicatively interconnects the oxygen-supplying passage 6 with the oxygen supply source. This control valve is designed to be used for controlling the flow rate of oxygen introduced into the combustion chamber 4. More specifically, the control valve employed in the oxygen heater of this embodiment is capable of controlling the oxygen flow rate at least within the rage of 1 to 5 times more than an oxygen flow rate which is theoretically adequate to completely burn the fuel supplied to the combustion chamber 4 at a predetermined flow rate. For example, if 1 mol of $C_3H_8$ is supplied as a fuel to the combustion chamber 4 per unit time, 5 mols of oxygen, theoretically, must be supplied to the combustion chamber 4 per unit time in order to completely burn the $C_3H_8$. In this case, the control valve is capable of controlling the flow rate of oxygen introduced into the combustion chamber 4 at least within the range of 5 to 25 mol per unit time.

Figure 10:
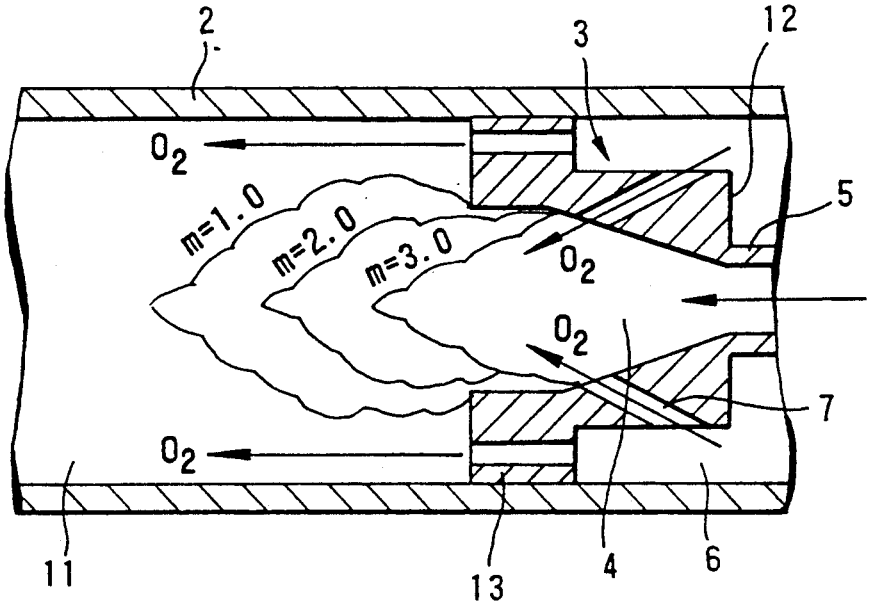
FIG. 10 is a diagram of flame size and flame shape in relation to different flow rates of auxiliary combustion oxygen supplied to a combustion chamber.

In the operation of the aforementioned oxygen heater, the fuel-supplying conduit 5 is supplied with the liquid or gaseous fuel a by the fuel supply source, while the oxygen-supplying passage 6 is supplied with oxygen b by the oxygen supply source. The fuel a is then introduced into the combustion chamber 4 at a predetermined flow rate, while, at the same time, a portion of the oxygen b is introduced into the combustion chamber 4 through the nozzle holes 7 at a flow rate 1 to 5 times (preferably 1 to 3 times) more than the flow rate which is theoretically adequate to completely burn the fuel in the combustion chamber. The portion of oxygen b, namely, auxiliary combustion oxygen is then mixed with the fuel a in the chamber 4, and the mixture of the fuel a and the auxiliary combustion oxygen b is burned in the combustion chamber 4. The burning mixture is then jetted out of the front opening 9 of the combustion chamber-defining member 3 and produces the flame 10 in the mixing chamber 11. In the mixing process taking place in the combustion chamber 4, the fuel and the auxiliary combustion oxygen are mixed extremely well and produce a stable flame since the nozzle holes 7 are oriented to direct the auxiliary combustion oxygen passing through the nozzle holes 7 in a path converging on the opening 9 and the center axis of the combustion chamber 4. Furthermore, since the supply of an adequate or excess amount of auxiliary combustion oxygen for completely burning the fuel is supplied to the combustion chamber 4, the size and shape of the flame 10 becomes smaller and shorter than the flame resulting from an incomplete combustion. FIG. 10 illustrates examples of the relative size and shape of flames which are generated under different flow rates of auxiliary combustion oxygen supplied to the combustion chamber 4. In this drawing, m represents a ratio defined by the following equation:

$m = n_1/n_0$ where $n_1$ is the number of mols of the auxiliary combustion oxygen supplied to the combustion chamber 4 per unit time, and $n_0$ is the number of mols of oxygen which is theoretically necessary to completely burn the fuel introduced into the combustion chamber 4 per unit time. As will be understood from FIG. 10, the larger the value of m becomes, the more the axial length and lateral length of the flame are reduced. Therefore, in this embodiment in which m is not less than the value 1, the internal wall 2 is adequately spaced from the flame 10 so that the heat transfer rate between the flame 10 and the internal wall 2 is appreciably reduced. However, if m exceeds a value of 3, the potential exists for the flame to be blown out due to excess supply of the auxiliary combustion oxygen; and if m exceeds a value of 5, the probability is high that the flame 10 will be blown out. For this reason, it is preferred that the auxiliary combustion oxygen is supplied to the combustion chamber 4 at a flow rate which does not allow ratio m to exceed the value 3. In addition, if m is less than the value 1, the flame temperature will be too low due to incomplete combustion to heat the curtain oxygen d to the desired temperature, and also the flame 10 would be spread on the internal wall 2, which will necessitate the size of the internal wall 2 to be undesirably enlarged.

The other portion of the oxygen gas (i.e., most of the oxygen gas) b is jetted out of the outlet holes 8 into the mixing chamber 11, and forms the oxygen curtain d surrounding the flame 10. This oxygen curtain absorbs the radiant heat generated by the flame and hinders the heat by convection and conduction from being transferred to the internal wall 2.

As described above, the supply of adequate or excess auxiliary combustion oxygen, as well as the oxygen curtain, prevents the internal wall 2 from being damaged by the heat of the flame 10. The curtain oxygen and the combustion gas produced by the flame 10 are mixed together within the mixing chamber 11, resulting in the production of initial hot oxygen-enriched gas containing combustion gas, having a levelled temperature distribution, which forms the hot gas flow e and is supplied to the place where it is demanded. In addition, since the heater has the mixing chamber 11 and there are produced in the heater the flame 10 for heating the curtain oxygen, it is possible, by using this oxygen heater, to reduce the heat loss and thus to efficiently produce hot oxygen. Also for the same reason, the oxygen heater can be miniaturized.

Although in the foregoing embodiment, a plurality of outlet holes 8 are formed in the combustion chamber-defining member 3, an annular slit which opens to both the front and rear faces of the flange portion 13 may be formed in the flange portion 13 instead of the outlet holes 8. Also, the shape of internal wall 2 and the shape of combustion chamber-defining member 3 are not limited to the shapes in the foregoing embodiment. For example, internal wall 2, as well as the combustion chamber-defining member 3 and the combustion chamber 4, may be of a substantially polygonal cross section.

Embodiment 2

Figure 3:
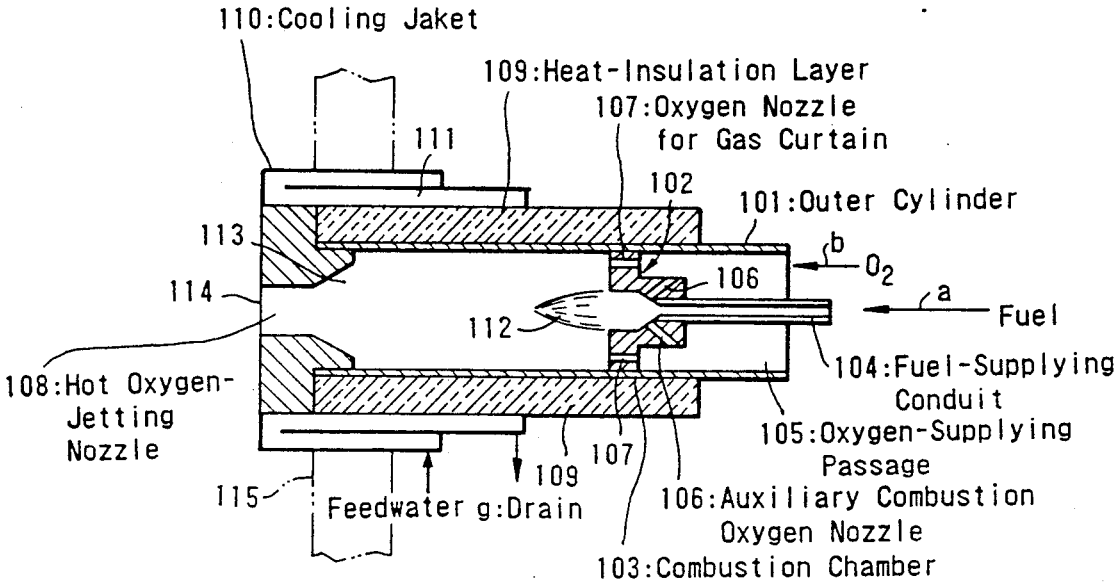
FIG. 3 is an axial-sectional view of a hot oxygen lance according to embodiment 2 of the present invention.
Figure 4:
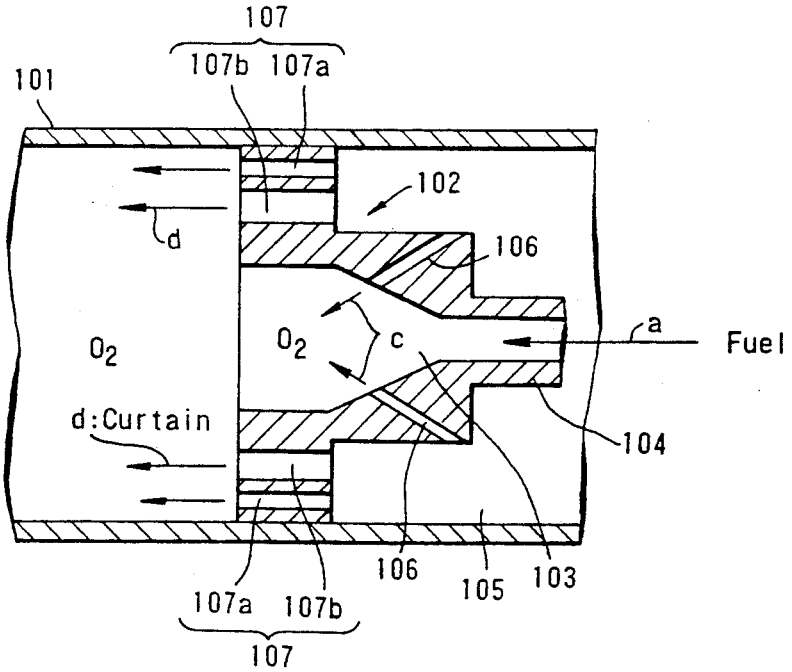
FIG. 4 is an enlarged axial-sectional view of an oxygen heater shown in FIG. 3.

FIG. 3 shows a hot oxygen lance according to the second aspect of the present invention. In FIG. 3, reference numeral 101 designates an outer cylinder, and reference numeral 102 designates an oxygen heater disposed within the the outer cylinder 101. An enlarged axial-sectional view of the oxygen heater is shown in FIG. 4. Reference numeral 103 denotes a combustion chamber, 104 denotes a fuel-supplying conduit, 105 denotes an oxygen-supplying passage, 106 denotes nozzle holes for auxiliary combustion oxygen, 107 denotes nozzles or outlet holes for curtain oxygen, 107*a* denotes outer outlet holes for outer curtain oxygen, and 107*b* denotes inner outlet holes for inner curtain oxygen. Reference numeral 108 designates a hot oxygen-enriched gas-jetting outlet, 109 designates a heat-insulating layer, 110 designates a jacket for cooling water, 111 designates a partition inside the jacket 110, 112 designates a flame, 113 designates a mixing chamber for mixing combustion gas and curtain oxygen, 114 designates a front end opening of the lance, and 115 designates a furnace wall. Also, in FIGS. 3 and 4, arrow a means fuel flow, arrow b means oxygen flow, arrow c means flow of auxiliary combustion oxygen, arrow d means curtain oxygen flow, arrow e means hot oxygen containing combustion gas flow, arrow f means feedwater flow and arrow g means drain flow.

The device illustrated in FIGS. 3 and 4 merely serves as a hot oxygen lance. This oxygen lance is provided at the center of the outer cylinder 101 and behind the front end opening 114, with the oxygen heater 102 which has the combustion chamber 103 and the outlet holes 107. The combustion chamber 103 is provided for mixing the fuel with the auxiliary oxygen and for burning the mixture. The outlet holes 107 surround the combustion chamber 103 to direct the oxygen flow passing therethrough to form an oxygen curtain. Each of the outer outlet holes 107*a* has a inner diameter smaller than the inner diameter of each of the inner outlet holes 107*b*. The heat-insulating layer 109 is disposed around the outer cylinder 101, and the water jacket 110 is fitted around a nozzle defining the outlet 108 and the front portion of the heat-insulating layer 109. Although, in FIG. 3, the heat-insulating layer 109 covers that portion of the outer cylinder's outer face from the front end nearly to the periphery of oxygen heater 102, it may cover only a portion of the outer cylinder from the position where the flame 112 is formed to the mixing chamber 113. Although the jacket 110 fits around that portion of the lance which is to be disposed inside the furnace so that the lance is prevented from being damaged, it may fit around the entire lance. The jacket 110 shown in FIG. 3 is not the cooling means for the outer cylinder 101, therefore it will be required to dispose a water cooling jacket 110 around the outer cylinder 101 instead of the heat-insulating layer 109 in order to protect the outer cylinder 101 from the heat of the hot oxygen gas when the temperature of the hot oxygen gas exceeds 1,200° C.

Figure 11:
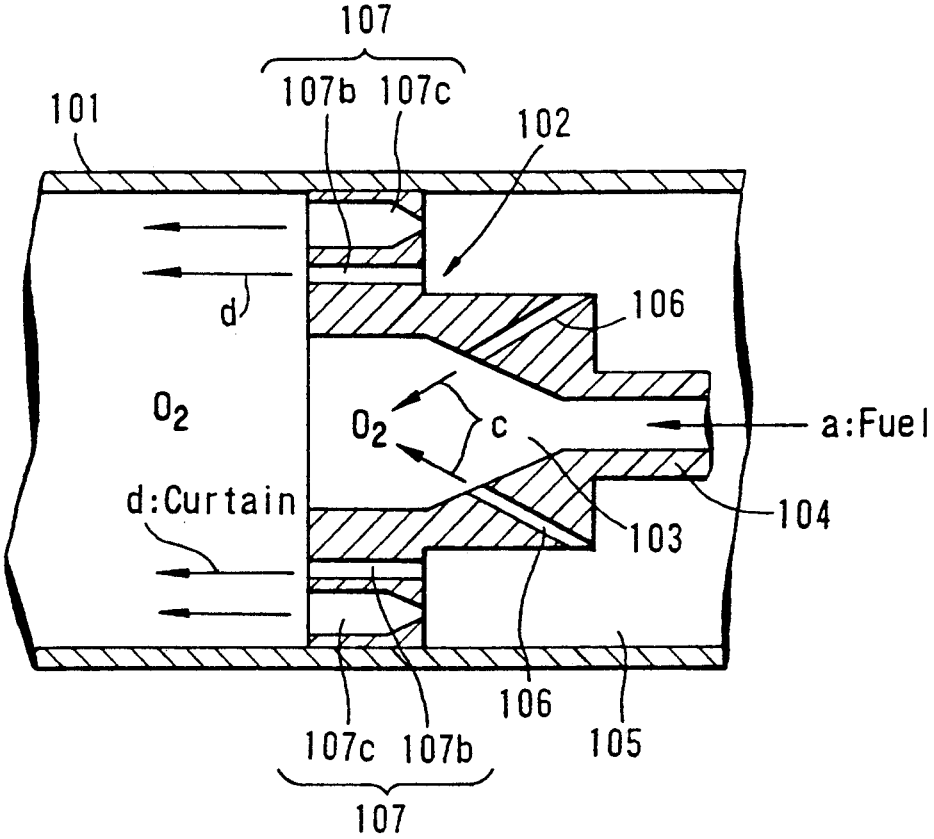
FIG. 11 is an axial-sectional view of an modified form of the oxygen heater shown in FIG. 4.

Both the curtain oxygen outlet holes 107 and the auxiliary combustion oxygen nozzle holes 106 are supplied with oxygen through one passage, that is, the oxygen-supplying passage 105. The ratio between the respective flow rates of the auxiliary combustion oxygen and curtain oxygen depends on pressure resistance in the auxiliary combustion oxygen nozzle holes 106. In this embodiment, the flow rate of the auxiliary combustion oxygen introduced into the combustion chamber 103 is also controlled by a control means such as the control valve described in Embodiment 1. In place of the oxygen-supplying passage 105, there may be employed two passages for supplying oxygen respectively to the outlet and nozzle holes 106 and 107. Alternatively, oxygen may be supplied by two passages branched before the oxygen was introduced into outer cylinder 101 of the lance. However, these arrangements are not preferred since it causes complications in the construction of the lance. In place of the outer outlet holes 107*a*, outer outlet holes such as shown in FIG. 11 by reference numeral 107*c* may be employed. Each of these outer outlet holes 107*c* has an inner diameter which increases rapidly as the corresponding outer outlet hole 107*c* extends forward along the direction of the oxygen flow.

In this oxygen lance, the fuel-supplying conduit 104 is supplied with gaseous or liquid fuel a, and the oxygen-supplying passage 105 is supplied with oxygen gas b. The fuel a is then introduced in to the combustion chamber 103 at a predetermined flow rate, while at the same time, a portion of the oxygen gas b (i.e., arrow c) is introduced into the combustion chamber 103 through the nozzle holes 106 at a flow rate 1 to 5 times more than the flow rate which is theoretically adequate to completely burn the fuel in the combustion chamber 103. The portion of oxygen b, that is, auxiliary combustion oxygen is then mixed with the fuel a in the combustion chamber 103. This mixture of the fuel a and the auxiliary combustion oxygen b is then burned and produces the flame 112. When the fuel a is propane, the maximum temperature of the flame 112 is approximately 2,700° C. On the other hand, the remainder of the oxygen b is introduced into the outlet holes 107 and, as shown by arrow d, is jetted out of the outlet holes 107, forming a oxygen curtain between the outer cylinder 101 and the flame 112. This oxygen curtain reduces the heat transfer to the outer cylinder 101 to the smallest possible degree. Next, within the mixing chamber 113, the curtain oxygen is mixed with the hot combustion gas generated due to the flame 112, resulting in the production of the hot oxygen-enriched combustion gas. This hot oxygen-enriched combustion gas is then, as shown by arrow e, discharged in a jet from the opening 114 of the outlet 108 into the furnace.

An oxygen heating test was carried out, in which the oxygen lance previously described was supplied with 0.30 $Nm^3/h$ of fuel propane gas, 1.5 to 4.5 $Nm^3/h$ of auxiliary combustion oxygen, and 25.0 to 22.0 $Nm^3/h$ of curtain oxygen. The respective flow rates of the auxiliary combustion oxygen and the curtain oxygen were determined such that the sum of the flow rates of the oxygen supplied to the oxygen lance is 26.5 $Nm^3/h$. As a result, there was produced 27.1 $Nm^3/h$ of a hot oxygen-enriched combustion gas. The temperature and the oxygen content of the hot oxygen-enriched combustion gas are shown in Table 1.

TABLE 1

| | |
|---|---|
| Required Preheated $O_2$* ($Nm^3/h$) | 25.0 |
| Fuel $C_3H_8$ ($Nm^3/h$) | 0.30 |
| Theo. Aux. Combustion $O_2$* ($Nm^3/h$) | 1.5 |
| Curtain $O_2$ ($Nm^3/h$) | 25.0–22.0 |
| Auxiliary Combustion $O_2$* ($Nm^3/h$) | 1.5–4.5 |
| Total $O_2$* ($Nm^3/h$) | 26.5 |
| Resultant Hot Gas* ($Nm^3/h$) | 27.1 |
| Oxygen Content of Hot Gas (%) | 92.3 |
| Temperature of the Hot Gas (°C.) | 800 |

*"Required Preheated $O_2$" means the flow rate of oxygen required to be preheated.
*"Theo. Aux. Combustion $O_2$" means the flow rate of auxiliary combustion oxygen theoretically adequate to completely burn 0.3 $Nm^3/h$ of fuel propane gas.
*"Auxiliary Combustion $O_2$" means the flow rate of oxygen which is supplied to the combustion chamber, which means that all the oxygen introduced into the combustion chamber does react with the fuel.
*"Total $O_2$" means the sum of the flow rates of the oxygen supplied to the oxygen lance.
*"Hot Gas" means hot oxygen-enriched combustion gas.

Embodiment 3

Figure 5:
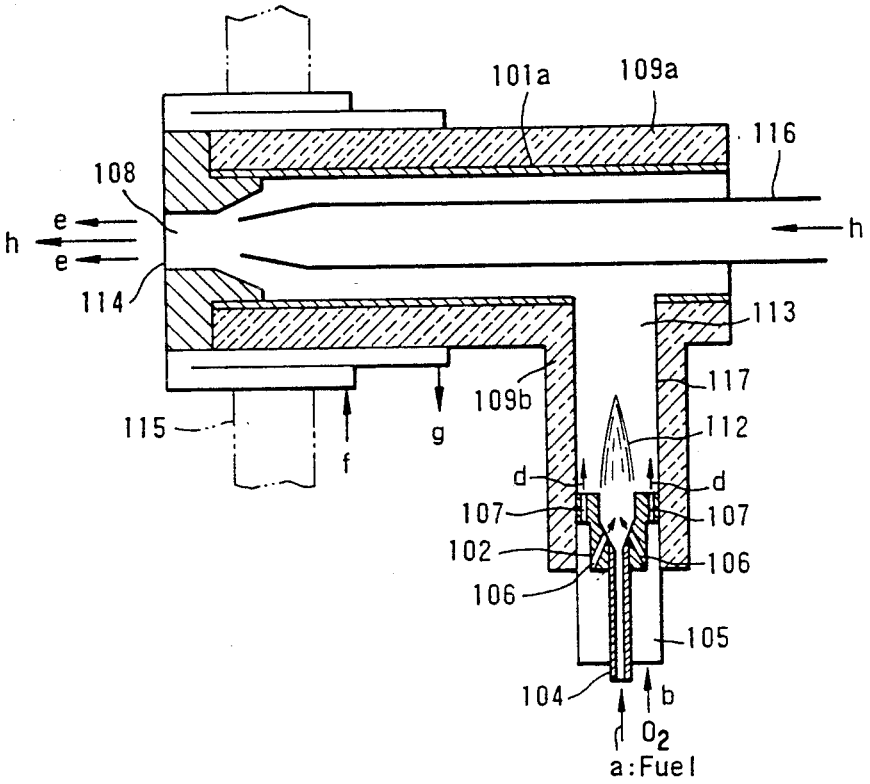
FIG. 5 is an axial-sectional view of a hot oxygen lance according to embodiment 3 of the present invention.

FIG. 5 shows another hot oxygen lance according to the second aspect of the present invention. In this lance, there are disposed not only a branch cylinder 117 for supplying hot oxygen-enriched gas but also a center pipe 116 coaxial with the outer cylinder 101*a* in order to supply a furnace with pulverized material for refining such as, cokes, pulverized coal and iron ore. This center pipe 116 may be a pipe for observing the inside of the furnace instead of being the pulverized material-supplying pipe. Because the center pipe 116 takes up the center position of the outer cylinder 101*a*, the outer cylinder 101*a* is provided with a branch cylinder 117 in which the oxygen heater 102 is disposed. Although the branch cylinder 117 in FIG. 5 is connected perpendicularly to the outer cylinder 101*a*, the angle between the outer cylinder and the branch cylinder may be set at random.

In FIG. 5, like reference characters as in FIG. 2 designate corresponding parts, and descriptions of the corresponding parts are omitted. The reference numeral 101*a* denotes the main outer cylinder, 116 denotes the center pipe, 117 denotes the branch cylinder, 109*a* denotes a heat-insulating layer for the main outer cylinder, 109*b* denotes a heat-insulating layer for the branch cylinder, and reference letter h denotes a flow of the pulverized material for refining.

The functions of the branch pipe 117 and the oxygen heater 102 are the same as that of the oxygen heater of embodiment 2. The pulverized material for refining is introduced into the center pipe 116 by a carrier gas such as carbon monoxide and argon, and is jetted from the nozzle 108 into the furnace together with hot oxygen containing combustion gas.

Embodiment 4

Figure 6:
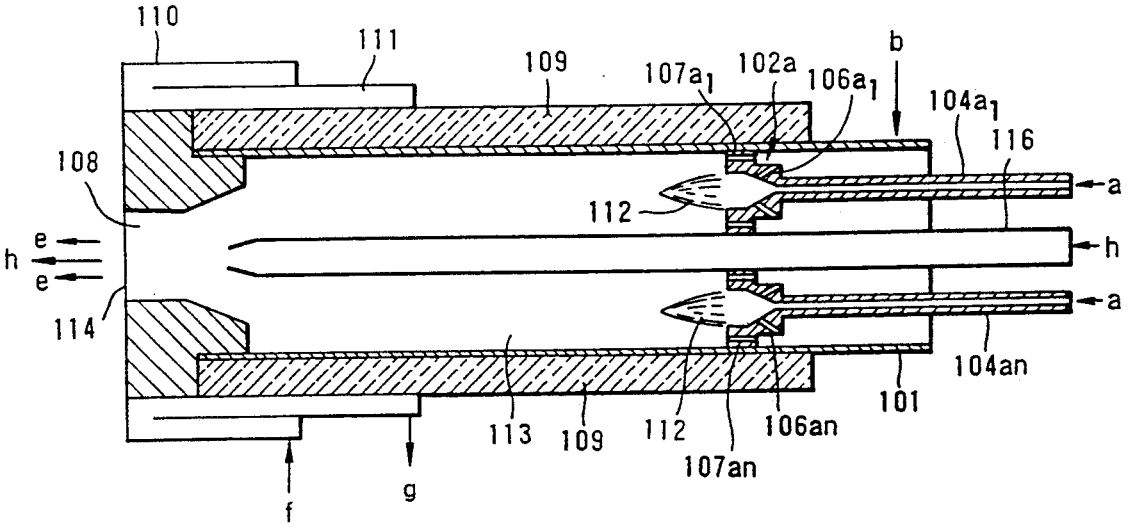
FIG. 6 is an axial-sectional view of embodiment 4.

FIG. 6 illustrates still another oxygen lance according to the second aspect of the present invention. This lance is also used for supplying hot oxygen and has a center pipe 116 at the center of the lance. The center pipe 116 is also used either as a pipe for supplying the pulverized material or as a pipe for observing the inside of the furnace. In the lance of embodiment 3, the existence of the branch cylinder 117 causes the entire construction of the lance to be complicated, whereby there arises inconveniences such as difficulty in manufacturing the lance and difficulty in operating the lance. In contrast, the lance of this embodiment has both an oxygen heater 102*a* and a center pipe 116 which is coaxially disposed in the outer cylinder 101. The oxygen heater 102*a* has a plurality of combustion chambers $\mathbf{103}a_1$ to $\mathbf{103}a_n$ defined around the center pipe 116. The heater 102*a* is provided with a plurality of oxygen nozzles or outlet holes $\mathbf{107}a_1$ to $\mathbf{107}a_n$ consisting of small holes or slits, for directing oxygen passing through the outlet holes to form an oxygen curtain enclosing the combustion chambers.

Figure 7:
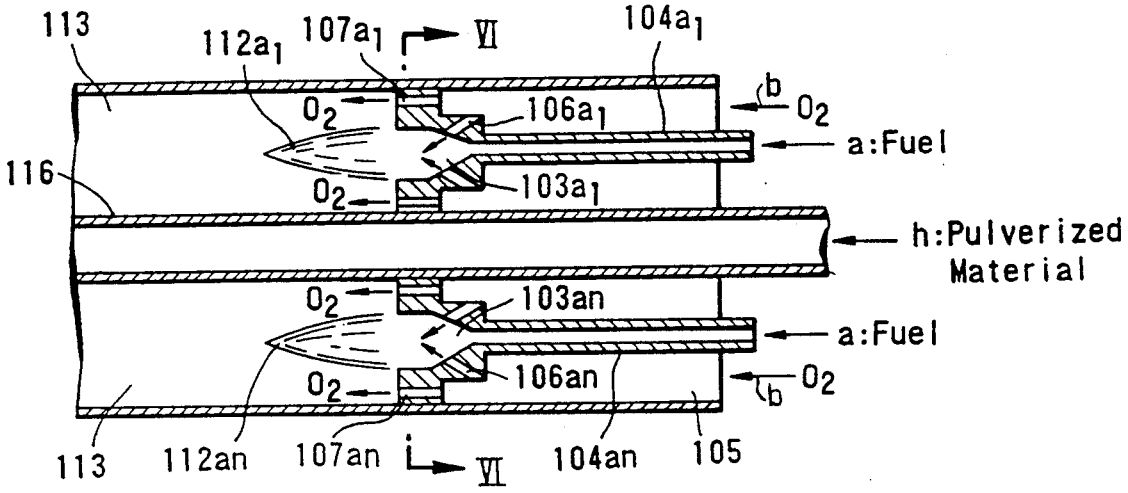
FIG. 7 is an enlarged sectional view of an oxygen heater shown in FIG. 6.
Figure 8:
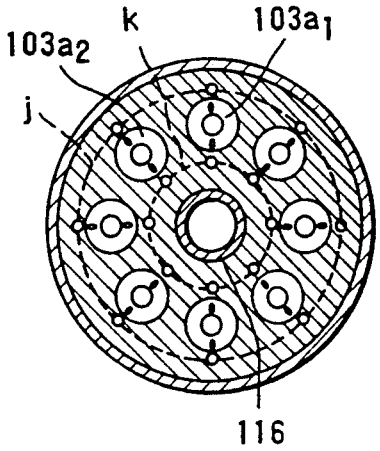
FIG. 8 is a view taken along the line VI—VI in FIG. 7.

FIG. 7 is an enlarged axial-sectional view of the oxygen heater 102*a*. FIG. 8 is a view taken along the line VI—VI in FIG. 7. In these drawings, like reference characters as in embodiments 2 and 3 designate corresponding parts, and descriptions of the corresponding parts are omitted. Reference numerals $\mathbf{103}a_1$ to $\mathbf{103}a_n$ designate the combustion chambers, $\mathbf{104}a_1$ to $\mathbf{104}a_n$ designate conduits for supplying the combustion chambers with fuel, $\mathbf{106}a_1$ to $\mathbf{106}a_n$ designate auxiliary combustion oxygen nozzle holes for introducing the auxiliary combustion oxygen into the combustion chambers, and 107$a_1$ to 107$a_n$ denote oxygen curtain nozzles or outlet holes for directing oxygen passing therethrough to form the oxygen curtain enclosing the combustion chambers. In the same manner as embodiment 2, other oxygen curtain nozzles consisting of another annular row of nozzles may be provided around the annular row of the nozzles 107$a_1$ to 107$a_n$. Reference numerals 112$a_1$ to 112$a_n$ designate flames produced in the combustion chambers. Reference letter j designates an oxygen curtain formed between the outer cylinder 101 and the combustion chambers 103$a_1$ to 103$a_n$ by the oxygen jetted out of the curtain nozzles 107$a_1$ to 107$a_n$, and reference letter k also designates an oxygen curtain formed between the center pipe 116 and the combustion chambers 103$a_1$ to 103$a_n$.

The fuel for the lance may be carried to the lance by a single passage which extends to the entrance of the outer cylinder 101 to connect with the fuel-supplying conduits 104$a_1$ to 104$a_n$. Otherwise, the single passage extends into the outer cylinder 101 reaching in the vicinity of the oxygen heater 102*a*. The former single passage makes the construction of the entire lance more complicated.

The oxygen may be introduced into the outer cylinder by means of an oxygen supply source and a conduit and is distributed into the auxiliary combustion oxygen and the curtain oxygen. The ratio between the flow rate of the auxiliary combustion oxygen and the flow rate of the curtain oxygen depends on the pressure resistance of both the nozzles 106$a_1$ to 106$a_n$ and the nozzles 107$a_1$ to 107$a_n$. Each of the combustion chambers may have its own oxygen-supplying conduit connected to the corresponding combustion chamber. However, such oxygen-supplying conduits are not preferred since they cause the construction of the lance to be complicated.

The functions of the lance having the oxygen heater of this embodiment are the same as that of the lance of embodiment 2. One additional function of the lance of this embodiment is that the oxygen curtain k is formed between the center pipe 116 and the combustion chambers 103$a_1$ to 103$a_n$ as well as the oxygen curtain j between the outer cylinder 101 and the combustion chambers. The oxygen curtain k prevents the center pipe 116 from being overheated.

Also, the lance of this embodiment has the merit that it is easier to manufacture and to handle in comparison with the hot oxygen lance of embodiment 3.

Table 2 shows the temperature and the oxygen content of a produced hot oxygen-enriched combustion gas when the lance of this embodiment has eight combustion chambers and is supplied with 0.35 $Nm^3/h$ of fuel propane gas, 1.75 to 5.25 $Nm^3/h$ of auxiliary combustion oxygen and 25.00 to 21.50 $Nm^3/h$ of curtain oxygen. The respective flow rates of the auxiliary combustion oxygen and the curtain oxygen were determined such that the sum of the flow rates of the oxygen supplied to the oxygen lance is 26.75 $Nm^3/h$.

TABLE 2

| | |
|---|---|
| Required Preheated $O_2$* ($Nm^3/h$) | 25.00 |
| Fuel $C_3H_8$ ($Nm^3/h$) | 0.35 |
| Theo. Aux. Combustion $O_2$* ($Nm^3/h$) | 1.75 |
| Curtain $O_2$ ($Nm^3/h$) | 25.00–21.50 |
| Auxiliary Combustion $O_2$* ($Nm^3/h$) | 1.75–5.25 |
| Total $O_2$* ($Nm^3/h$) | 26.75 |
| Resultant Hot Gas* ($Nm^3/h$) | 27.45 |
| Oxygen Content of Hot Gas (%) | 91.1 |

TABLE 2-continued

| | |
|---|---|
| Temperature of the Hot Gas (°C.) | 800 |

*"Required Preheated $O_2$" means the flow rate of oxygen required to be preheated.
*"Theo. Aux. Combustion $O_2$" means the flow rate of auxiliary combustion oxygen theoretically adequate to completely burn 0.35 $Nm^3/h$ of fuel propane gas.
*"Auxiliary Combustion $O_2$" means the flow rate of oxygen which is supplied to the combustion chamber, which means that all the oxygen introduced into the combustion chamber does react with the fuel.
*"Total $O_2$" means the sum of the flow rates of the oxygen supplied to the oxygen lance.
*"Hot Gas" means hot oxygen-enriched combustion gas.

Embodiment 5

Figure 9:
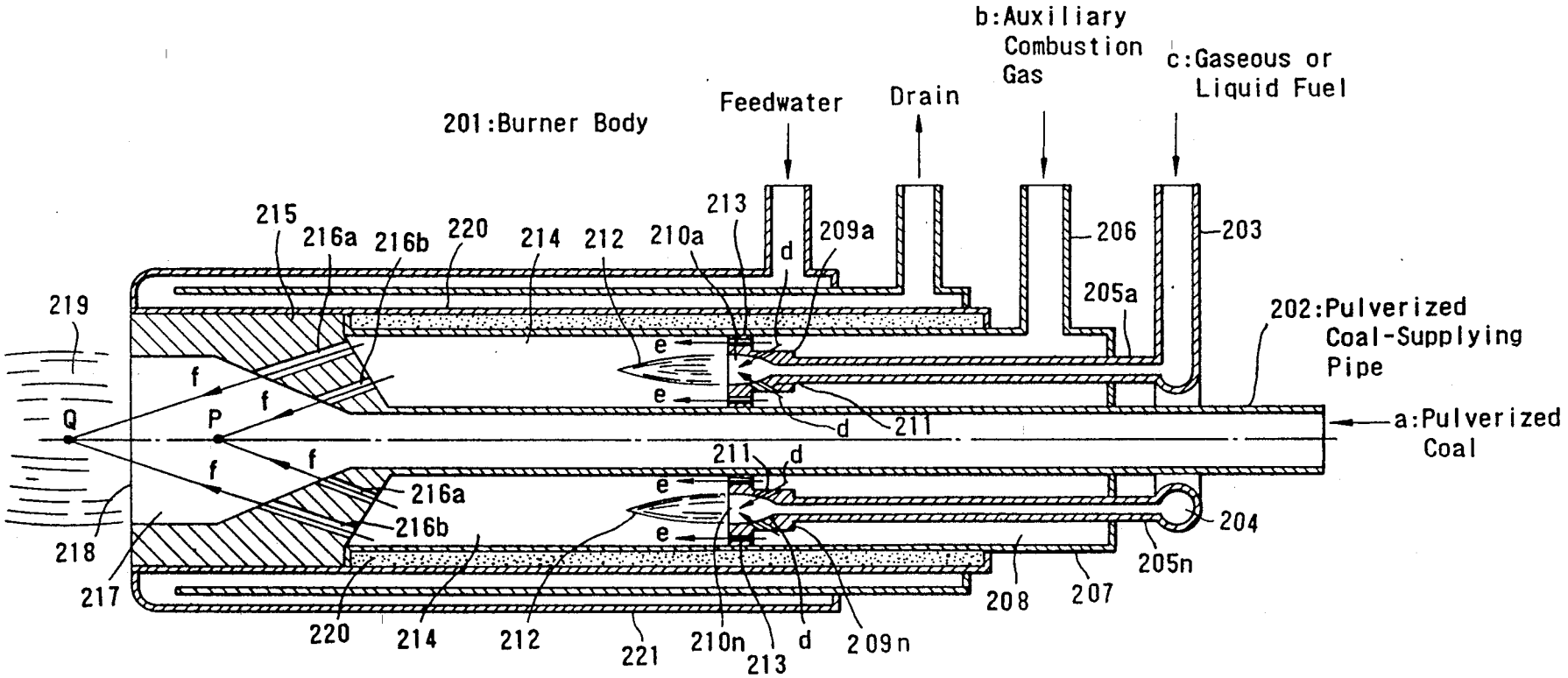
FIG. 9 is an axial-sectional view of a pulverized coal burner according to embodiment 5 of the present invention.

FIG. 9 illustrates a pulverized coal burner according to the third aspect of the present invention. In this drawing, reference numeral 201 denotes a burner body. 202 designates a pulverized coal-supplying pipe. 203 denotes a conduit for supplying gaseous or liquid fuel for the preheating of auxiliary combustion gas. 204 designates a branch pipe for supplying gaseous or liquid fuel. Reference numerals 205*a* to 205*n* denote pipes for supplying gaseous or liquid fuel for the preheating of auxiliary combustion gas. Reference numeral 206 designates an auxiliary combustion gas-supplying conduit. This conduit 206 is provided with a control means such as a control valve for controlling the flow rate of auxiliary combustion gas supplied to the sub-combustion chamber (which will be described later). In case that the auxiliary combustion gas is oxygen, the control valve is a valve capable of controlling the flow rate of oxygen introduced into the sub-combustion chamber within the range of 1 to 5 times more than an oxygen flow rate which is theoretically adequate to completely burn the fuel supplied to the sub-combustion chamber at a predetermined flow rate. 207 designates an auxiliary combustion gas supplying pipe. 208 denotes a passage defined by the pipes 202 and 207 which are coaxial to each other. Reference numerals 209*a* to 209*n* denote a plurality of auxiliary combustion gas heaters circumferentially disposed around the pulverized coal-supplying pipe 202. 210*a* to 210*n* denote combustion chambers (the sub-combustion chamber) formed in the auxiliary combustion gas heaters. Reference numeral 211 denotes an auxiliary combustion gas nozzle for jetting auxiliary combustion gas into the combustion chambers 210*a* to 210*n*. 212 denotes a flame for preheating auxiliary combustion gas. 213 denotes a curtain nozzle for jetting auxiliary combustion gas so that the flow of auxiliary combustion gas forms a auxiliary combustion gas curtain enclosing the combustion chambers 210*a* to 210*n*. 214 denotes a mixing chamber for mixing hot combustion gas with auxiliary combustion gas having room temperature. 215 denotes a member forming a pulverized coal combustion nozzle. Reference numerals 216*a* and 216*b* denote nozzles for jetting hot auxiliary combustion gas. 217 denotes a main combustion chamber. 218 denotes a flame-throwing opening. 219 denotes a flame due to the combustion of pulverized coal. The hot auxiliary combustion gas-jetting nozzles 216*a* and 216*b* consist of a plurality of small holes or slits oriented to direct the auxiliary combustion gas passing therethrough in a path converging on points P and Q which are positioned on the center axis of the burner body 201 and in the vicinity of the opening 218. Naturally, other annular rows (3 or 4 rows) of the auxiliary combustion gas-jetting nozzles other than the nozzles 216*a* and 216*b*, may be formed in the nozzle-forming member 215.

Reference numeral 220 designates a heat-insulating layer disposed on the entire outer surface of auxiliary combustion-supplying pipe 207. This heat-insulating layer hinders heat generated by the auxiliary combustion gas heater 209*a* to 209*n* from being convectively transferred radially outward.

Reference numeral 221 designates a cooling jacket for circulating cooling water therein. This jacket 221 is provided to prevent the front end portion of the burner, that is, mainly the forming member 215, from being damaged by the radiation heat radiated from the flame 219 and the furnace.

Reference letter a denotes pulverized coal, b denotes auxiliary combustion gas which may be comprised oxygen, oxygen-enriched air, or air, c denotes gaseous or liquid fuel, d denotes auxiliary combustion gas used for burning the fuel and preheating the curtain gas, e denotes auxiliary combustion gas used for forming the gas curtain, and f denotes a flow of hot auxiliary combustion gas.

In the aforementioned burner, pulverized coal, that is, the main fuel is introduced into the pulverized coal supplying pipe 202 together with a carrier gas such as monoxide carbon and argon. On the other hand, the gaseous or liquid fuel for preheating the auxiliary combustion gas is introduced into the gaseous or liquid fuel-supplying conduit 203, and is supplied into the gaseous or liquid fuel-supplying pipes 205*a* to 205*n* through the branch pipe 204. The gaseous or liquid fuel, then, reaches the auxiliary combustion gas heaters 209*a* to 209*n* and is introduced into the combustion chambers 210*a* to 210*n*. The auxiliary combustion gas is introduced into the auxiliary combustion gas-supplying conduit 206, and reaches the auxiliary combustion gas heaters 209*a* to 209*n* via the auxiliary combustion gas supplying passage 208. A portion of the auxiliary combustion gas is, then, introduced into the combustion chambers 210*a* to 210*n* through the auxiliary combustion gas nozzle 211. Subsequently, the auxiliary combustion gas introduced into the combustion chambers 210*a* to 210*n* is mixed with the gaseous or liquid fuel which has been introduced into the combustion chambers 210*a* to 210*n*. The mixture of the fuel and the auxiliary combustion gas is then burned in the combustion chambers 210*a* to 210*n*, whereby the flame 212 for preheating the auxiliary combustion gas is produced. The other portion of the auxiliary combustion gas passes through the curtain nozzles 213 and forms an auxiliary combustion gas curtain enclosing the combustion chambers 210*a* to 210*n*. The gas curtain protects the auxiliary combustion gas-supplying pipe 207 by hindering the heat from being convectively transferred from the preheating flame 212 to the gas supplying pipe 207. The gas curtain also minimizes the heat loss.

The preheating flames 212 formed in each combustion chamber 210*a* to 210*n* produces hot combustion gas. This hot combustion gas is mixed with the curtain gas within the mixing chamber 214, whereby hot auxiliary combustion gas is produced. Then, this hot auxiliary combustion gas is introduced into the nozzles 216*a* and 216*b*, and is jetted out of the nozzles 216*a* and 216*b* into the main combustion chamber 217. The pulverized coal, which is introduced into the supplying pipe 202 together with the carrier gas, is jetted into the main combustion chamber 217, and then, is mixed with the hot auxiliary combustion gas having been jetted into the chamber 217. Then, the mixture of the pulverized coal and the hot auxiliary combustion gas at the same time as it is being burned, is jetted out of the opening 218, whereby the flame 219 due to the combustion of the pulverized coal is produced. Since the auxiliary combustion gas introduced into the combustion chamber 217 is hot, the combustion in the chamber 217 continues in a stable manner, resulting in the production of a stable flame having a temperature of approximately 2,000° to 2,400° C.

Also, by setting the distance between the main combustion chamber 217 and the auxiliary combustion gas heaters 209*a* to 209*n* at an adequate distance, it is possible to preheat the pulverized coal in the supplying pipe 202 by convectively transferring heat from the hot auxiliary combustion gas to the pulverized coal via the pipe wall. This operation makes it easier for the burner to produce a more stable flame.

What is claimed is:

1. An oxygen heater for heating oxygen, the oxygen heater comprising:

an internal wall of a mixing chamber;

oxygen supply means for supplying oxygen to the inside of the internal wall;

a combustion chamber-defining member disposed inside the internal wall and defining a combustion chamber, communicating with the oxygen supply means, for both mixing and burning fuel with oxygen supplied thereto, the combustion chamber having an opening for blowing a flame;

fuel supply means for supplying fuel to said combustion chamber; and an oxygen-jetting opening, disposed around the opening of the combustion chamber and communicating with the oxygen supply means, for allowing oxygen supplied thereto to flow out therefrom and to form an oxygen curtain, the oxygen curtain being positioned between the internal wall of the mixing chamber and a flame due to the combustion in the combustion chamber to protect the internal wall from heat emitted by the flame; wherein the fuel supply means supplies the fuel to said combustion chamber at a predetermined flow rate, the oxygen heater further comprising control means for controlling chamber within the range of 1 to 5 times more than an oxygen flow rate which is theoretically adequate to completely burn the fuel supplied to the combustion chamber at said predetermined flow orate, so that fuel supplied to the combustion chamber is burned with an adequate or excess amount of oxygen.

2. An oxygen heater as recited in claim 1, wherein the range of the oxygen flow rate controllable by the control means is 1 to 3 times more than an oxygen flow rate which is theoretically adequate to completely burn the fuel supplied to the combustion chamber at said predetermined flow rate.

3. An oxygen heater as recited in claim 1, wherein the control means comprises a control valve disposed between the oxygen supply means and the combustion chamber.

4. An oxygen heater as recited in claim 1, wherein the oxygen-jetting opening comprises a plurality of nozzles.

5. An oxygen heater as recited in claim 1, wherein the oxygen-jetting opening comprises at least one slit.

6. An oxygen heater as recited in claim 1, wherein the oxygen-jetting opening is arranged so that a multilayer of oxygen curtains are formed.

7. An oxygen heater as recited in claim 6, wherein the oxygen-jetting opening is arranged so that an inner oxygen curtain formed by the oxygen flowing out from the oxygen-jetting opening is of a flow velocity higher than the flow velocity of the outer adjoined oxygen curtain.

8. A hot oxygen lance comprising an outer cylinder having an inner face or wall, oxygen supply means for supplying oxygen to the inside of the outer cylinder, an oxygen heater disposed within the outer cylinder, and the oxygen heater defining a combustion chamber having a front opening for blowing a flame, a plurality of nozzle holes for jetting auxiliary combustion oxygen of said combustion chamber, each nozzle hole extends along a line so that oxygen to be discharged from the nozzle holes and to be jetted into the combustion chamber is directed toward the vicinity of the intersection of a longitudinal axis of the internal wall and the front opening of the combustion chamber, the combustion chamber defining member communicating with the oxygen supply means, for both mixing and burning fuel with oxygen supplied thereto, the oxygen heater comprising:

fuel supply means for supplying fuel to said combustion chamber; and oxygen nozzles, surrounding the front opening of the combustion chamber and communicating with the oxygen supply means, for allowing oxygen supplied thereto to flow out therefrom and to form an oxygen curtain, the oxygen curtain being disposed between the inner wall of the outer cylinder and a flame due to the combustion in the combustion chamber to protect the outer cylinder from heat emitted by the flame, wherein the outer cylinder comprises a main outer pipe, and a branch pipe connected to the main pipe, and wherein the oxygen heater is disposed within the branch pipe.

9. A hot oxygen lance comprising an outer cylinder having an inner face or wall, oxygen supply means for supplying oxygen to the inside of the outer cylinder, an oxygen heater disposed within the outer cylinder, and the oxygen heater defining a combustion chamber having a front opening for blowing a flame, a plurality of nozzle holes for jetting auxiliary combustion oxygen through said combustion chamber, each nozzle hole extends along a line so that oxygen to be discharged from the nozzle holes and to be jetted into the combustion chamber is directed toward the vicinity of the intersection of a longitudinal axis of the internal wall and the front opening of the combustion chamber, the combustion chamber defining member communicating with the oxygen supply means, for both mixing and burning fuel with oxygen supplied thereto, the oxygen heater comprising:

fuel supply means for supplying fuel to said combustion chamber; and oxygen nozzles, surrounding the front opening of the combustion chamber and communicating with the oxygen supply means, for allowing oxygen supplied thereto to flow out therefrom and to form an oxygen curtain, the oxygen curtain being disposed between the inner wall of the outer cylinder and a flame due to the combustion in the combustion chamber to protect the outer cylinder from heat emitted by the flame, wherein the fuel supply means supplies the fuel to said combustion chamber at a predetermined flow rate, the oxygen heater further comprising control means for controlling the flow rate of oxygen supplied to the combustion chamber within the range of 1 to 5 times more than an oxygen flow rate which is theoretically adequate to completely burn the fuel supplied to the combustion chamber at said predetermined flow rate, so that fuel supplied to the combustion chamber is burned with an adequate or excess amount of oxygen.

10. A hot oxygen lance as recited in claim 9, wherein the oxygen nozzles are arranged so that a multilayer of oxygen curtains are formed.

11. A hot oxygen lance as recited in claim 10, wherein the oxygen nozzle is arranged so that an inner oxygen curtain formed by the oxygen flowing out from the oxygen nozzles is of a flow velocity higher than the flow velocity of the outer adjoined oxygen curtain.

12. A hot oxygen lance as recited in claim 9, wherein the fuel is selected from the group consisting of gaseous fuel and liquid fuel.

13. A hot oxygen lance as recited in claim 9, wherein the outer cylinder comprises a main outer pipe, and a branch pipe connected to the main pipe, and wherein the oxygen heater is disposed within the branch pipe.

14. A hot oxygen lance comprising an outer cylinder having an inner face or wall, a heat-insulating layer and/or a cooling jacket disposed around a part or all of the outer surface of the outer cylinder, oxygen supply means for supplying oxygen to the inside of the outer cylinder, the oxygen heater defining a combustion chamber having an opening for blowing a flame, a plurality of nozzle holes for jetting auxiliary combustion oxygen through said combustion chamber, each nozzle hole extends along a line so that oxygen to be discharged from the nozzle holes and to be jetted into the combustion chamber is directed toward the vicinity of the intersection of a longitudinal axis of the internal wall and the front opening of the combustion chamber, the combustion chamber defining member communicating with the oxygen supply means, for both mixing and burning fuel with oxygen supplied thereto, the oxygen heater comprising:

fuel supply means for supplying fuel to said combustion chamber; and oxygen nozzles, surrounding the front opening of the combustion chamber and communicating with the oxygen supply means, for allowing oxygen supplied thereto to flow out therefrom and to form an oxygen curtain, the oxygen curtain being disposed between the inner wall of the outer cylinder and a flame due to the combustion in the combustion chamber to protect the outer cylinder from heat emitted by the flame, wherein the outer cylinder comprises a main outer pipe, and a branch pipe connected to the main pipe, and wherein the oxygen heater is disposed within the branch pipe.

15. A hot oxygen lance comprising an outer cylinder having an inner face or wall, a heat-insulating layer and/or a cooling jacket disposed around a part of or all of the outer surface of the outer cylinder, oxygen supply means for supplying oxygen to the inside of the outer cylinder, the oxygen heater defining a combustion chamber having an opening for blowing a flame, a plurality of nozzle holes for jetting auxiliary combustion oxygen through said combustion chamber, each nozzle hole extends along a line so that oxygen to be discharged from the nozzle holes and to be jetted into the combustion chamber is directed toward the vicinity of the intersection of a longitudinal axis of the internal wall and the front opening of the combustion chamber, the combustion chamber defining member communicating with the oxygen supply means, for both mixing and burning fuel with oxygen supplied thereto, the oxygen heater comprising:

fuel supply means for supplying fuel to said combustion chamber; and oxygen nozzles, surrounding the front opening of the combustion chamber and communicating with the oxygen supply means, for allowing oxygen supplied thereto to flow out therefrom and to form an oxygen curtain, the oxygen curtain being disposed between the inner wall of the outer cylinder and a flame due to the combustion in the combustion chamber to protect the outer cylinder from heat emitted by the flame, wherein the fuel supply means supplies the fuel to said combustion chamber at a predetermined flow rate, the oxygen heater further comprising control means for controlling the flow rate of oxygen supplied to the combustion chamber within the range of 1 to 5 times more than an oxygen flow rate which is theoretically adequate to completely burn the fuel supplied to the combustion chamber at said predetermined flow rate, so that fuel supplied to the combustion chamber is burned with an adequate or excess amount of oxygen.

16. A hot oxygen lance as recited in claim 15, wherein the oxygen nozzles are arranged so that a multilayer of oxygen curtains are formed.

17. A hot oxygen lance as recited in claim 16, wherein the oxygen nozzles are arranged so that an inner oxygen curtain formed by the oxygen flowing out from the oxygen nozzles is of a flow velocity higher than the flow velocity of the outer adjoined oxygen curtain.

18. A hot oxygen lance as recited in claim 15, wherein the fuel is selected from the group consisting of gaseous fuel and liquid fuel.

19. A hot oxygen lance as recited in claim 15, wherein the outer cylinder comprises a main outer pipe, and a branch pipe connected to the main pipe, and wherein the oxygen heater is disposed within the branch pipe.

* * * * *